US005510675A

United States Patent [19]

Bunk et al.

[11] Patent Number: 5,510,675

[45] Date of Patent: Apr. 23, 1996

[54] FLICKER-SUPPRESSED, LOW-POWER, HIGH-PRESSURE DISCHARGE LAMP

[75] Inventors: Axel Bunk, München; Jürgen Vom Scheidt, Berlin, both of Germany

[73] Assignee: Patent-Treuhand-Gesellschaft fuer Elektrische Gluehlampen mbH, Munich, Germany

[21] Appl. No.: 6,728

[22] Filed: Jan. 21, 1993

[30] Foreign Application Priority Data

Feb. 11, 1992 [DE] Germany ..... 42 03 976.2

[51] Int. Cl.[6] ..... H01J 17/04; H01J 61/04

[52] U.S. Cl. ..... 313/631; 313/344; 313/574; 313/628; 313/632

[58] Field of Search ..... 313/631, 632, 313/344, 574, 621, 628, 631, 633, 575

[56] References Cited

U.S. PATENT DOCUMENTS

| | | | |
|---|---|---|---|
| 2,687,489 | 8/1954 | Anderson et al. . | |
| 3,067,357 | 12/1962 | Fridrich . | |
| 3,170,081 | 2/1965 | Rokosz | 313/631 |
| 3,778,664 | 12/1973 | Petro et al. | 313/344 |
| 4,275,329 | 6/1981 | Fridrich et al. | 313/344 |
| 4,340,836 | 7/1982 | Bergman et al. | 313/344 |
| 4,528,478 | 7/1985 | Rothwell, Jr. et al. | 313/631 |
| 4,766,348 | 8/1988 | English et al. | 313/631 |
| 4,851,735 | 7/1989 | Gosslar et al. . | |
| 5,004,951 | 3/1991 | Honda et al. | 313/631 |

FOREIGN PATENT DOCUMENTS

| | | |
|---|---|---|
| 0269957 | 8/1988 | European Pat. Off. . |
| 2718527 | 11/1978 | Germany . |

*Primary Examiner*—Sandra L. O'Shea
*Assistant Examiner*—Matthew J. Esserman
*Attorney, Agent, or Firm*—Frishauf, Holtz, Goodman, Langer & Chick

[57] ABSTRACT

To reduce flicker in low-power, high-pressure discharge lamps, the electrodes, in the region in which they face each other, have wrap windings, of about 2 to 4 turns wrapped thereabout and the terminal end of the electrode has an essentially spherical end head element (19, 19', 39) melted thereon, which essentially spherical head element may be a segment of a sphere, ellipsoid-shaped or similarly formed. The electrode shaft, the wrap winding and the sphere preferably are all made of undoped tungsten, although the electrode shaft may be of a lower melting metal, such as rhenium.

10 Claims, 5 Drawing Sheets

FLICKER-SUPPRESSED, LOW-POWER, HIGH-PRESSURE DISCHARGE LAMP

Reference to related patent, assigned to the assignee of the present application: German 27 18 527, Schmid et al. Reference to related application, assigned to the assignee of the present application: U.S. Ser. No. 08/006,727, filed Jun. 21, 1993, by the inventors hereof

FIELD OF THE INVENTION

The present invention relates to a high-pressure discharge lamp, and more particularly to a low-power, high-pressure discharge lamp, that is, a discharge lamp having a rated power of only up to about 400 W, filled with a metal halide fill, and which is so constructed that flicker, due to migration of the discharge arc on the electrodes, is effectively eliminated.

BACKGROUND

German Patent 27 18 527, Schmid et al, assigned to the assignee of the present application, describes a metal halide high-pressure discharge lamp for general service illumination. Such lamps, adapted to be connected to alternating current standard distribution networks, for example of 110 V, 60 Hz, or 220 V, 50 Hz, with or without accessory apparatus or ballasts are well known. Lamps of this type have operationally adequate firing and operating characteristics; it has been found, however, that after some operating time—which can differ widely between individual lamps—the light output is subject to flicker, which may be rhythmical or erratic, and at random.

Flicker, as usually referred to in lamp operation, refers to changes in light intensity emitted from the lamp, which may be periodical or entirely random and aperiodical. These variations in light output or light density can be measured, and the variations are referred to as a flicker factor. Investigations have shown that there is a direct proportionality between the flicker factor and the direct voltage proportion of the lamp current. It is believed that flicker is due to insufficient electrode temperature, which manifests itself in jumps of the arc attachment on the electrode at different arcing or arc origination points.

THE INVENTION

It is an object to provide a high-pressure discharge lamp with a metal halide fill which retains the advantages of high light output and high luminescent efficiency, but which, with respect to the prior art, has highly reduced, and preferably entirely eliminated flicker, so that the lamp not only will have good ignition and operating or burning characteristics, but additionally will retain its light output and its electrical operating characteristics over a long lifetime, essentially uniformly throughout the entire life of the lamp.

Briefly, the lamp, which as well known retains a metal halide fill within a discharge vessel, and has electrodes melt-sealed, with end portions facing each other. The two electrodes include, each, a straight shaft having an end portion facing the opposite electrode, and hence the discharge to be formed between the electrodes.

In accordance with a feature of the invention, the electrodes have a wrap winding applied around the end portions, in which the wrap winding has more than one, preferably several tightly adjacent windings or turns on the end portion of the electrodes. A solid, massive end head element, which at least in the portion thereof which faces the opposite electrode is rounded, preferably essentially spherical, is melt-connected or melted on the terminal end region of the end portion of the electrode shaft, or to the last one of the turns or windings of the wrap winding adjacent the terminal region, or connected to both the terminal region of the shaft as well as to the winding.

Preferably, the end head should have a substantial mass so that its heat retention capacity is high; yet, it should not be so large that too much heat energy is radiated, and the head becomes too cool. Preferably, the head is essentially spherical and has a diameter of between about 1.5 to 2.5 times the diameter of the electrode shaft; or, alternatively, it may be a spherical segment, having a spherical diameter of at least three times the diameter of the electrode shaft. This provides, in operation of the lamp, a heat balance of the head resulting in greatly reduced, or entirely eliminated flicker.

The essentially spherical end portion of the electrode head substantially reduces the random attachment of the discharge arc from one attachment point to another. Preferably, the surface of the spherical end portion is smooth, and the jumping or migration of the arc attachment is reduced as a consequence. The better the smoothness of the surface, the less migration of the attachment of the arc. It is not necessary that the end portion is exactly spherical, and "essentially spherical" as referred to herein means that the end portion is generally three-dimensionally rounded, and may deviate somewhat from a mathematical sphere, for example it can be, in cross section, generally oval, or have an ellipsoid shape.

To obtain a higher mass of the electrode head, and hence a higher heat retention capacity, the head portion should have good heat contact with the wrap winding. This can be obtained by, for example, melt-connecting the essentially spherical head end with the terminal turn of the wrap winding, or locating the essentially spherical head end in good heat contact and heat transmitting relation thereto. The surface facing the discharge is then not substantially cooled during current pauses so that, during lamp operation, the operating temperature of the head will remain essentially constant.

The surface of the essentially spherical end portion must not be too large in order to prevent loss of energy by heat radiation and, if the cooling is too great, interfere with ignition and arc acceptance of the electrode.

The wrap winding, preferably, has between 2–4 turns. The wrap winding is made of a wire which, preferably, has a wire diameter of between about half and two-thirds of the diameter of the electrode shaft. When using these dimensions, together with a diameter of a spherical end portion of between 1.5 to 2.5 times the shaft diameter or, for a spherical segment, about three times shaft diameter, a flicker factor of under 1% can be obtained with optimal starting of the arc between the electrodes.

DRAWINGS

DETAILED DESCRIPTION

Figure 1:
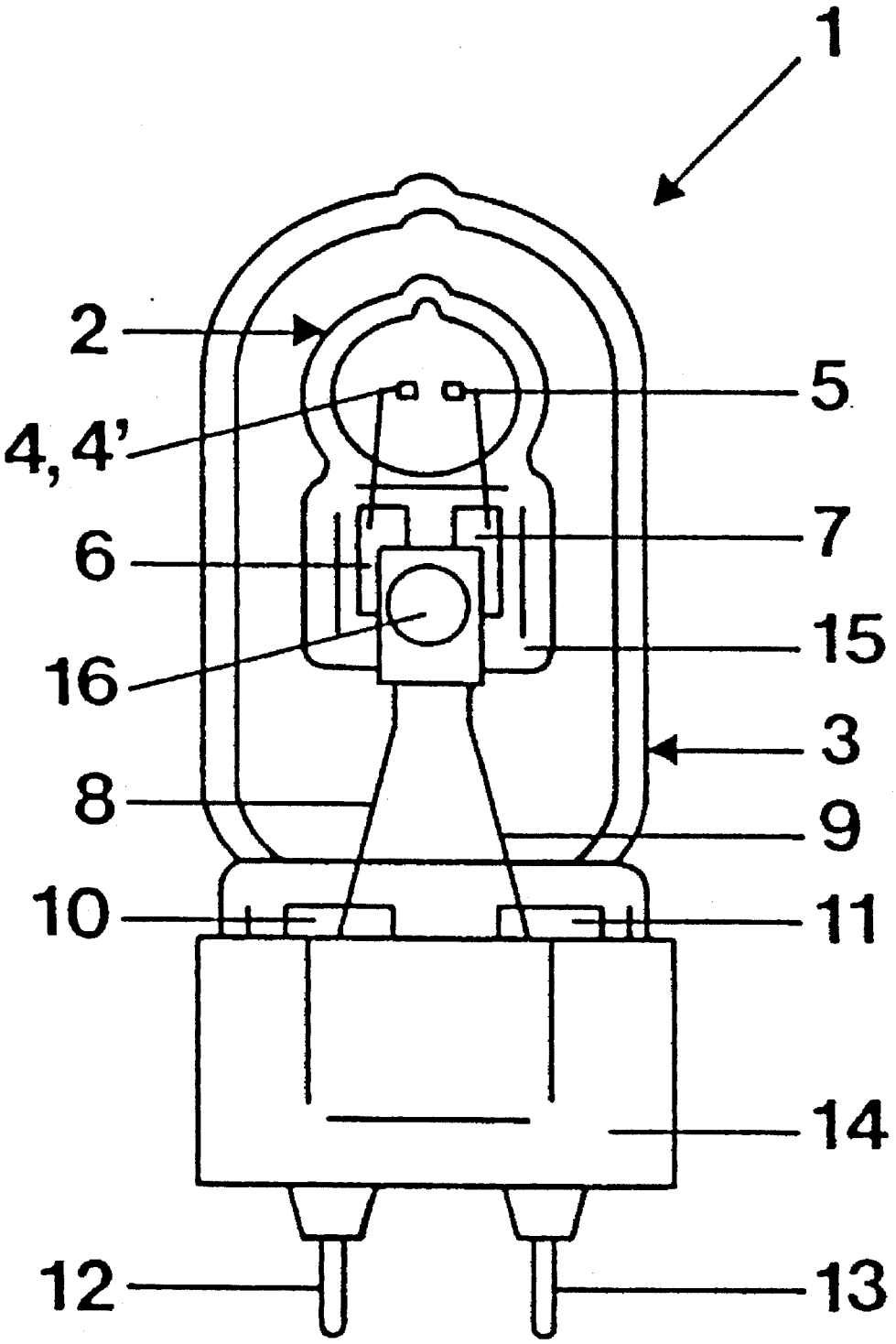
FIG. 1 is a highly schematic side view of a single-ended lamp in accordance with the present invention.

FIG. 1 illustrates a lamp in accordance with the present invention, and the example shown illustrates a 70 W high-pressure discharge lamp 1, which has a single-ended quartz-glass discharge vessel 2. The single-ended discharge vessel 2 is located within a single-ended, single pinch-sealed outer envelope or bulb 3, preferably also made of quartz glass, and sealingly surrounding the discharge vessel 2. The electrodes 4, 4' and 5 are shown only schematically. They are connected via/molybdenum sealing foils 6, 7 in the discharge vessel 2, pinch-sealed gas-tightly therein, and connected via further current supply leads 8, 9, sealing foils 10, 11, pinch-sealed through the outer envelope 3 and connected to short current supply pins 12, 13. The pinch seal of the lamp itself is retained within a ceramic base 14 of the type G12. A getter 16 is secured to the pinch seal 15 of the discharge vessel 2, for example attached to a small metal plate which, in turn, is held by a wire in the pinch seal, which wire is not connected to any one of the electrodes, so that it is voltage-free. The discharge vessel 2 retains a fill which, besides mercury, contains a noble gas, and metal iodides and bromides of the elements sodium, tin, thallium, indium and lithium.

Figure 2:
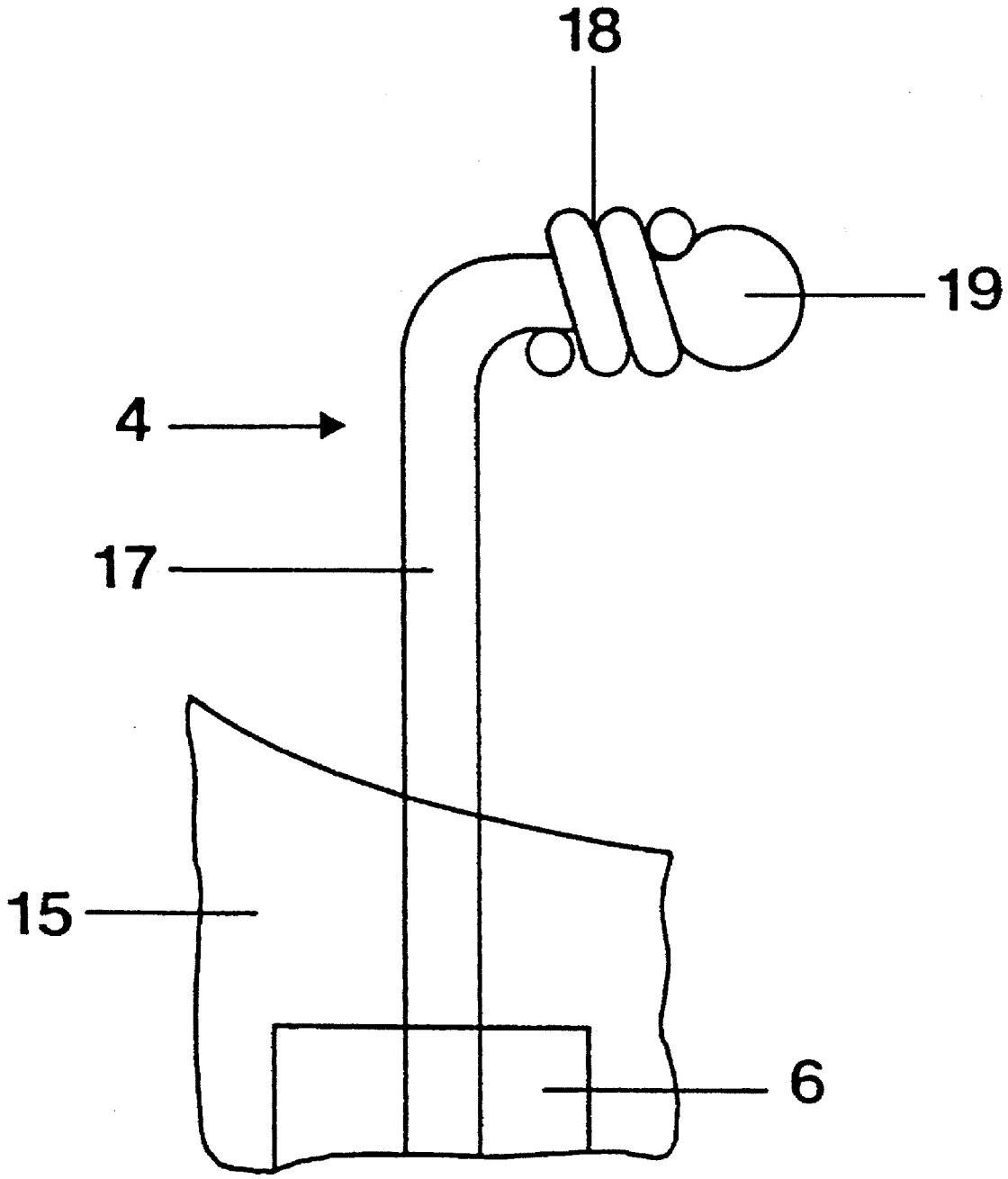
FIG. 2 is a schematic side view of an electrode for the lamp of FIG. 1.
Figure 3:
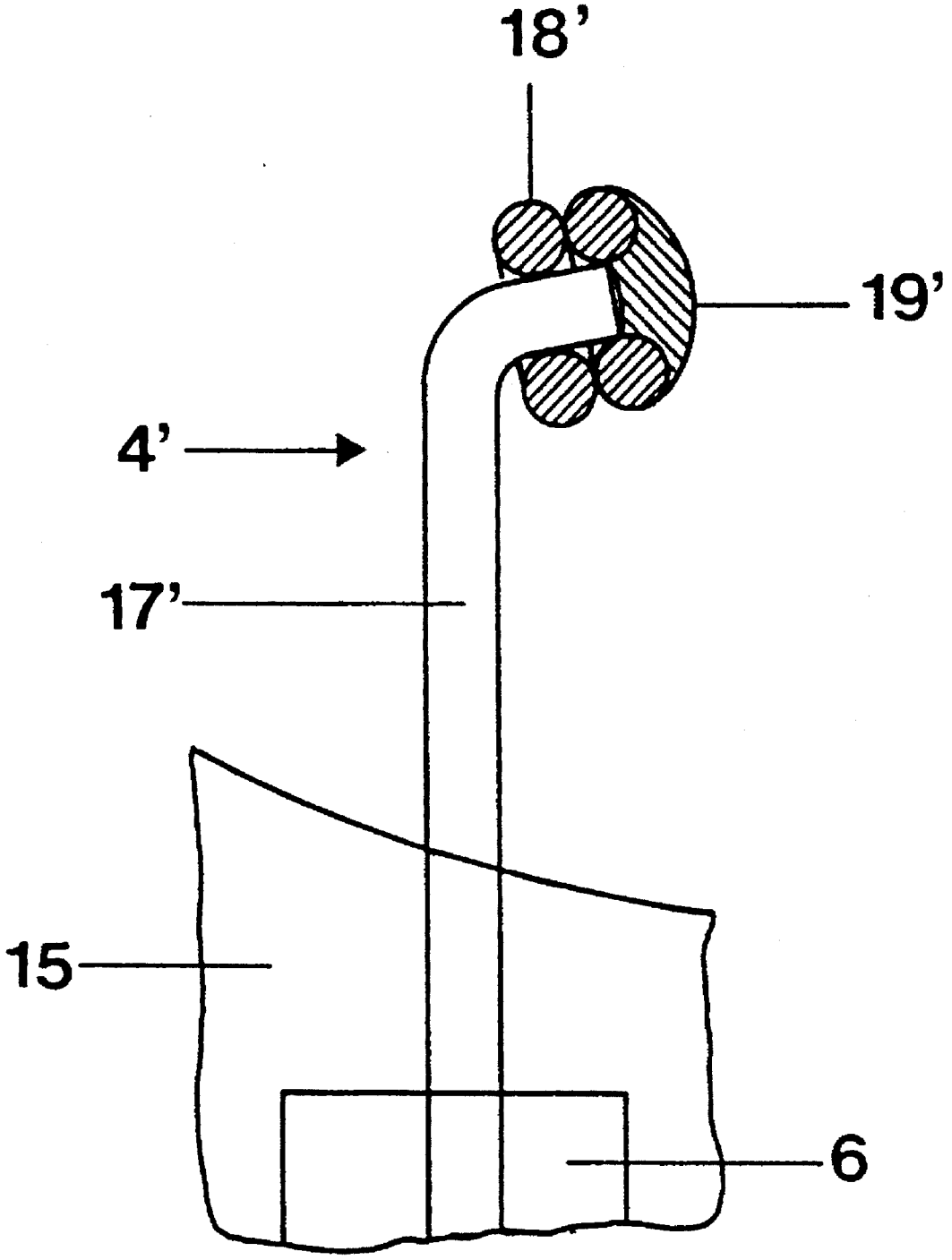
FIG. 3 is a side view, partly in section, of another embodiment of an electrode for the lamp of FIG. 1.

The lamp electrodes 4, 4' and 5 are shown in detail in FIGS. 2 and 3. In accordance with the invention, the electrode 4 (FIG. 2) has an electrode shaft 17, one end of which is connected to a molybdenum sealing foil 6 within the pinch seal 15, melt-sealed therein. The outer or free end portion of the shaft 17 is bent over 90°, facing the discharge arc, and the opposite electrode 5 (see FIG. 1). The shaft 17 has a diameter of about 0.4 mm. The end portion is wrapped by a wrap winding 18 having about 2.5 turns which are tightly wound against each other on the end of the portion of the shaft 17. The wire of the wire wrap 18 has a diameter of about 0.2 mm.

In accordance with a feature of the invention, the free end region of the shaft 17 has a ball or sphere 19 of about 0.7 mm/diameter melt-connected thereto to form an essentially single metallic structure with the shaft 17. The ball 19 is in tight engagement with the last turn of the winding 18.

All components of the electrode 4 are made of tungsten which is not doped.

FIG. 3 illustrates another embodiment, partially in section, in which the electrode 4' which, basically, is identical to the electrode 4, has a shaft 17', the end of which is melt-sealed via the molybdenum sealing foil 6 in the pinch seal 15. The other end of the shaft 17' which, again, is a tungsten wire of about 0.4 mm diameter, is bent over by 90°, and the end region or portion has a wrap winding 18' of about 2.5 windings of tungsten wire having a diameter of also 0.4 mm. The last one of the turns of the winding 18' has a cap 19' melted thereon, in which the cap 19' has generally or at least approximately, or essentially the form of a spherical segment. The radius of the spherical segment is about 1.4 mm. All electrode components can be made of essentially pure tungsten. The electrode shaft 17, however, may be made of a different metal which has a lower melting temperature than tungsten, for example, rhenium. If the electrode shaft is made of rhenium, the wrap winding 18' as well as the end cap or end head element 19' are both made either of pure tungsten or of doped tungsten.

Figure 4:
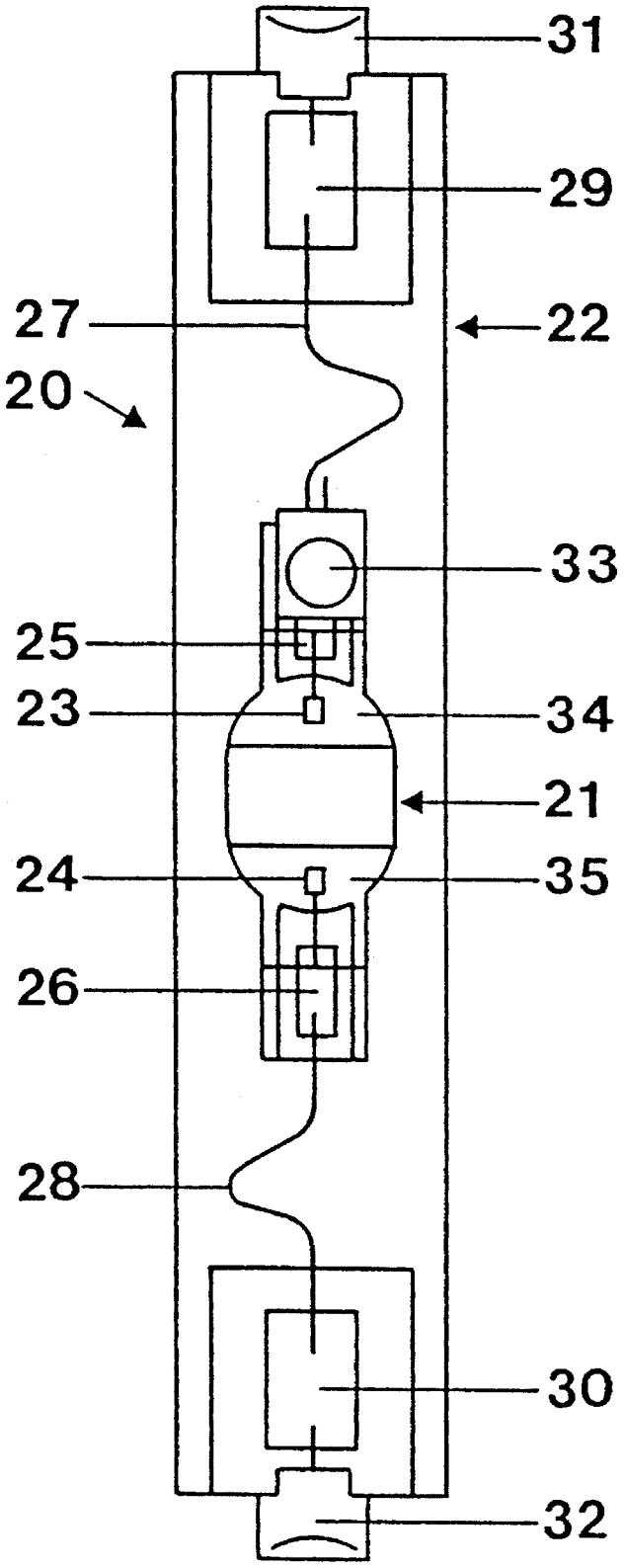
FIG. 4 is a side view of a double-ended lamp, having the electrodes in accordance with the present invention.

FIG. 4 illustrates an embodiment of the invention when used in a double-ended discharge lamp. The particular lamp shown in FIG. 4 is a 150 W high-pressure discharge lamp 20, having a double-ended discharge vessel 21 of quartz glass, retained within an outer envelope 2. The electrodes 23 and 24, shown only schematically in FIG. 4, are melt-sealed by foils 25, 26 in the discharge vessel 21 and connected via current supply leads 27, 28, further sealing foils 29, 30, and pinch-sealed through the outer envelope 22 and connected through further short current supply leads, as well known, with the electric connections of a ceramic base R7s 31, 32. The discharge vessel 21, which is also pinch-sealed, has a getter 33 voltage-free melt-sealed thereto, connected by a short wire.

The ends 34, 35 of the discharge vessel 21 are coated with a heat reflecting layer. The fill within the discharge vessel 21 contains mercury and a noble gas, and metal iodide and bromide, in which the metal is sodium, tin, thallium, indium and lithium.

Figure 5:
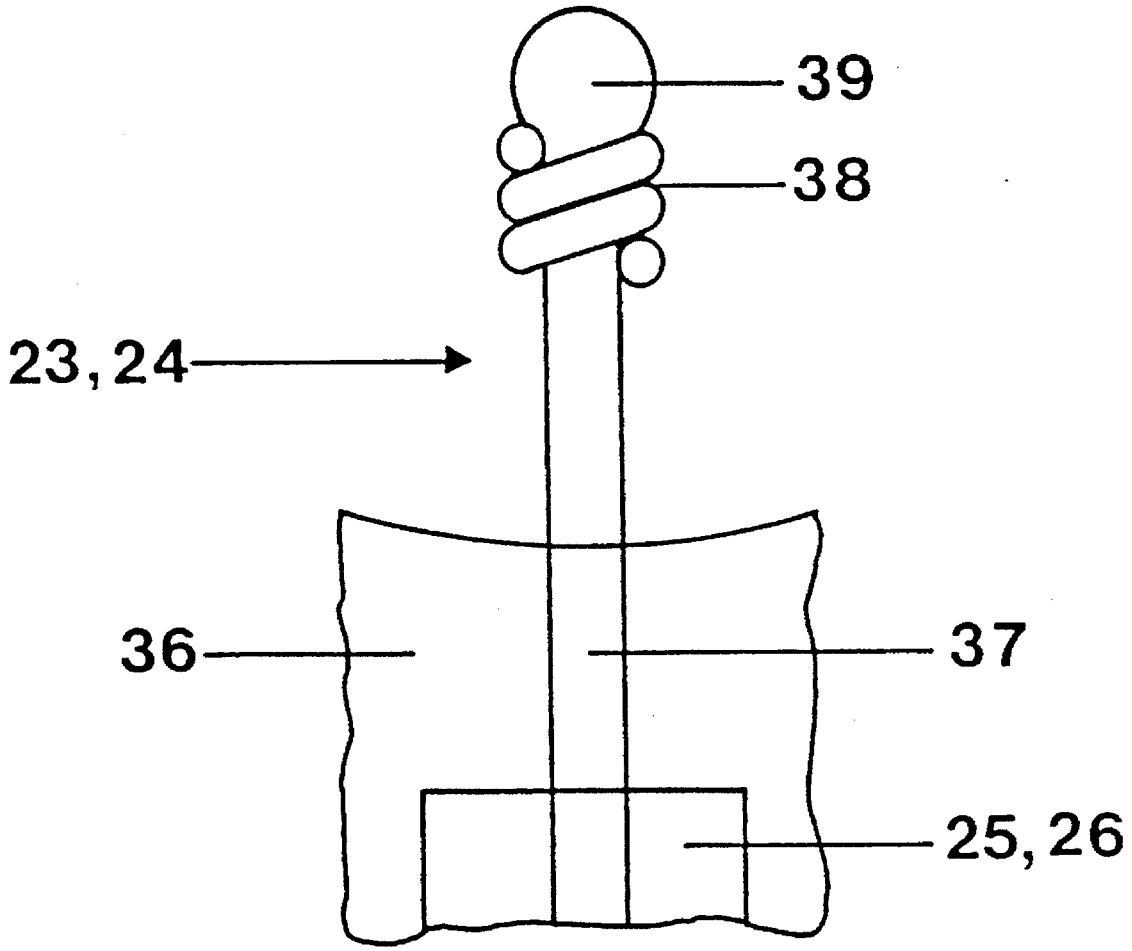
FIG. 5 is a greatly enlarged electrode suitable for the lamp of FIG. 4.

The electrodes 23, 24, as best seen in FIG. 5, have a straight shaft 37, one end of which is welded to the respective molybdenum sealing foil 25, 26, which, in turn, is melt-sealed in the pinch seal 36 of the discharge vessel 21. The other end of the shaft 37 carries a wrap winding 38, formed of 2.5/tightly adjacent turns of a wire of 0.3 mm diameter. The diameter of the electrode shaft 37 is about 0.5 mm.

In accordance with a feature of the invention, the tip or terminal end region of the shaft 37 has a ball or essential sphere 39 melted thereon. The ball or sphere 39 has a diameter of about 1 mm. The wrap winding 38 and the ball 39 are in heat transfer engagement, so that good thermal contact between the wrap winding and the ball 39 is ensured. All elements of the electrodes 23, 24 are made of undoped tungsten.

Various changes and modifications may be made, and any features described herein may be used with any of the others, within the scope of the inventive concept.

A suitable doping for the wrap winding 18, 18', 38 and the end head element 19, 19', 39, if the electrode shaft 17, 17', 37 is not made of tungsten, is either 0.4–3% thorium oxide or 0.000073% potassium, 0.000010% aluminum and 0.000005% silicon.

We claim:

1. Flicker-reduced, low-power, high-pressure discharge lamp (1, 20) having a power rating of up to about 400 W, comprising a discharge vessel (2, 21);

two electrodes (4, 4', 5; 23, 24) and connecting foils (6, 7; 25, 26) pinch-sealed into the discharge vessel;

wherein each electrode includes a straight shaft (17, 17', 37) having an end portion forming an electrode head facing the opposite electrode and hence the discharge to be formed between the electrodes;

a wrap winding (18, 18', 38) with more than one adjacent winding or turn on the respective end portion;

wherein the diameter of the wrap winding wire is between about half to the entire shaft diameter of the electrode shaft (17); and means for stabilizing, in operation of the lamp, attachment of the arc between the electrodes at the end portion of the respective electrode by providing a balance between heat retention and heat radiation from the head, and hence heat balance for flicker-reduced operation, said stabilizing means comprising the combination of a solid, massive end head element (19, 19', 39) which, at least in a portion thereof facing the opposite electrode, is of essentially at least part-spherical shape, melt-connected to at least one of: a terminal region of the end portion of the electrode shaft; the last turn or winding of said wrap winding adjacent said terminal region, with a fill including mercury, a metal halide, and a noble gas located within the discharge vessel (2, 21).

2. The lamp of claim 1, wherein said end head element (19, 19', 39) is in tight heat-transfer thermal contact with the wrap winding (18, 18', 38).

3. The lamp of claim 1, wherein (FIGS. 2, 5) the end head element (19, 39) comprises an essentially spherical or ball element, having a diameter of between about 1.5 to 2.5 times the diameter of the electrode shaft (17, 37).

4. The lamp of claim 1, wherein (FIG. 3) the end head element (19') comprises an essentially ball or sphere segment (19'), having a sphere radius of about 1.5 times the diameter of the electrode shaft (17).

5. The lamp of claim 1, wherein the wrap windings have between about 2 to 4 turns, optionally about 2½ turns.

6. The lamp of claim 1, wherein the electrodes are entirely made of essentially pure tungsten.

7. The lamp of claim 1, wherein the electrode shaft (17) is made of a material which has a lower melting temperature than tungsten;

and wherein the wrap winding (18, 18', 38) and the end head element (19, 19', 39) are made of essentially pure tungsten or of doped tungsten.

8. The lamp of claim 1, wherein the surface of the end head element, at least in the portion thereof facing the opposite electrode, is smooth.

9. The lamp of claim 1, wherein the shaft, at least at its end portion, has a thickness of between 0.4 and 0.5 mm.

10. The lamp of claim 1, wherein the wrap winding has a thickness of between 0.2 and 0.4 mm.

* * * * *